US005184565A

United States Patent [19]

Matthews

[11] Patent Number: 5,184,565

[45] Date of Patent: Feb. 9, 1993

[54] COLLAPSIBLE BOAT

[76] Inventor: Keith R. Matthews, 49 Seamons Close, Dunstable, Beds., England, LU6 3EQ

[21] Appl. No.: 674,353

[22] PCT Filed: Oct. 6, 1989

[86] PCT No.: PCT/GB89/01185

§ 371 Date: Apr. 8, 1991

§ 102(e) Date: Apr. 8, 1991

[87] PCT Pub. No.: WO90/03914

PCT Pub. Date: Apr. 19, 1990

[30] Foreign Application Priority Data

Oct. 7, 1988 [GB] United Kingdom ..... 8823586

[51] Int. Cl.[5] ..... B63B 7/00

[52] U.S. Cl. ..... 114/354

[58] Field of Search ..... 114/352-355, 114/359

[56] References Cited

U.S. PATENT DOCUMENTS

| | | | |
|---|---|---|---|
| 1,895,380 | 1/1933 | Elling | 114/354 |
| 2,504,256 | 4/1950 | Dittrich | 114/354 |
| 2,994,891 | 8/1961 | Przybylski | 114/354 |
| 4,282,616 | 8/1981 | Battershill | 114/354 |

*Primary Examiner*—Jesus D. Sotelo

[57] ABSTRACT

A collapsible boat comprising at least one pair of longitudinally hingedly interconnected base panels whose outer edges are hinged to side panels and a stern panel, the hinged rotation of the panels being such that when the boat is erected the side, stern and base panels hinge open to their maximum extent, the side panels being attached to vented compartments which admit and retain air when the boat is erected and thus constitute buoyancy tanks.

22 Claims, 8 Drawing Sheets

COLLAPSIBLE BOAT

This invention relates to boats.

Large sea-going boats and yachts have to carry smaller boats for life saving purposes and also to function as tenders for running between the vessel and the shore. Unfortunately the requirements of a lifeboat and those of a tender are such that it is generally necessary to have two separate boats. For example, inflatable craft are popular for lifeboats as they are 'unsinkable' due to the buoyancy of the inflated tanks, but they suffer a major disadvantage as tenders because due to their low draught they are easily blown off course. Thus it is commonplace for a vessel to carry inflatable lifeboats and separate dinghies as tenders. This is both expensive and requires greater space for storage than if a single craft can function as both lifeboat and tender. Space may be saved by having a collapsible tender.

The present invention is directed towards providing a collapsible craft and in preferred embodiments to craft that may function as a lifeboat or a tender.

Accordingly the invention provides a collapsible boat comprising at least one pair of longitudinally hingedly interconnected base panels the outer longitudinal edges of which are respectively hinged to side panels, the direction and extent of the hinged rotation of the panels being such that when the boat is erected the side and base panels hinge open to their maximum extent and to collapse the boat alternate hinges rotate in opposite senses so that the base panels fold inwardly of the side panels in a zig zag formation, and in which at least the side panels are attached to vented compartments which admit and retain air when the boat is erected to constitute buoyancy tanks.

The invention is now described by way of example with reference to the accompanying drawings in which.

Figure 4A:
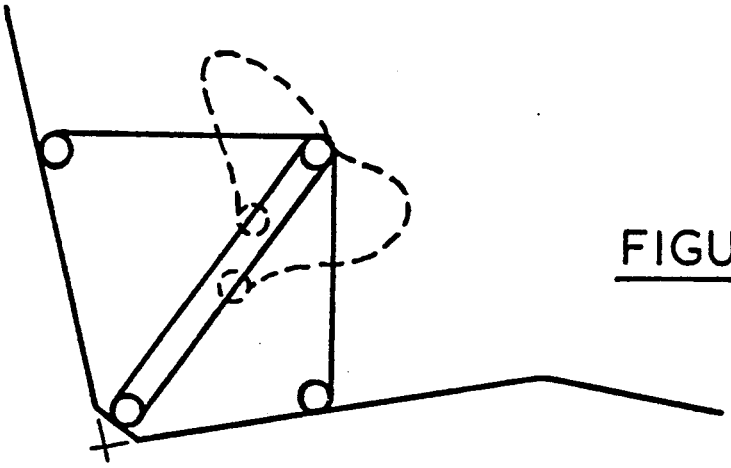
Figure 4B:
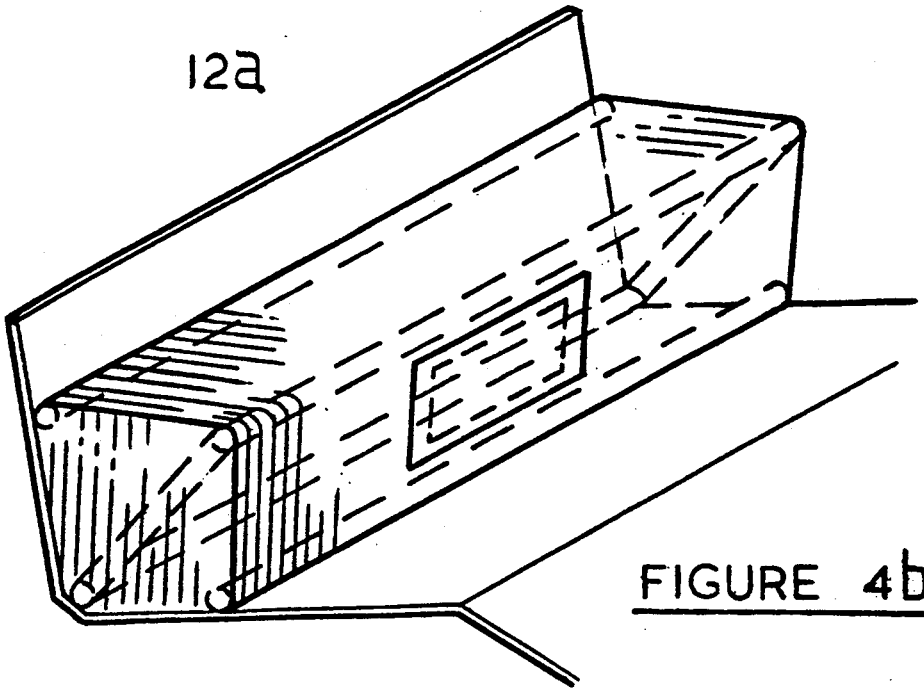
Figure 9:
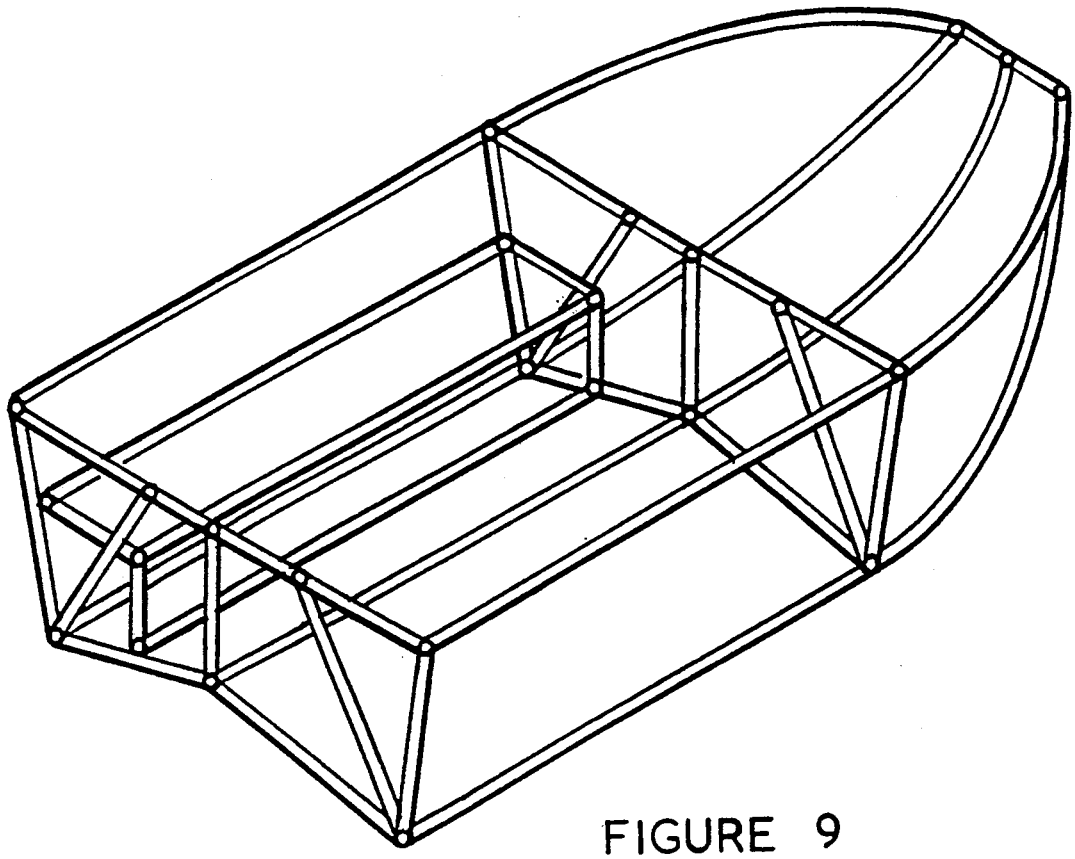
Figure 10:
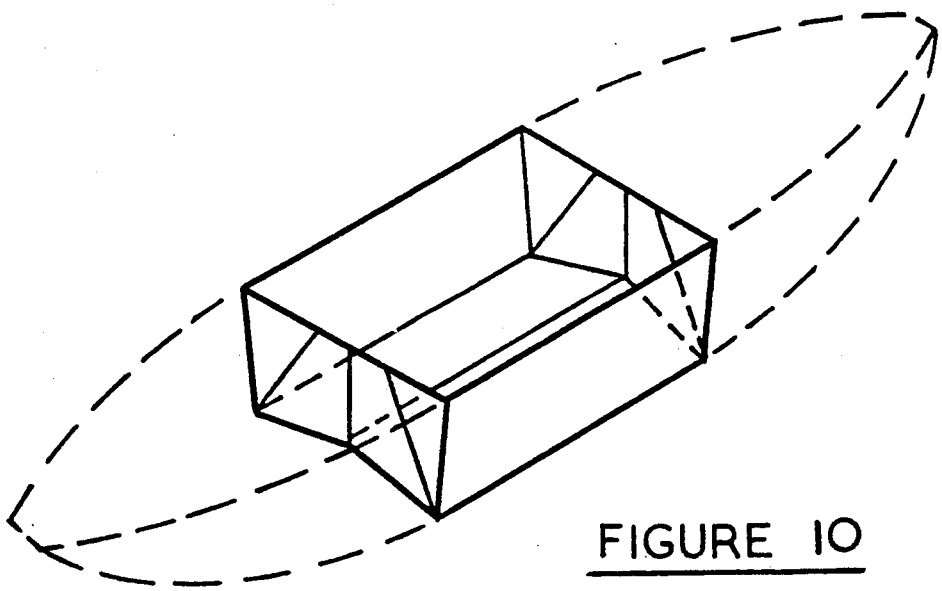
Figure 11A:
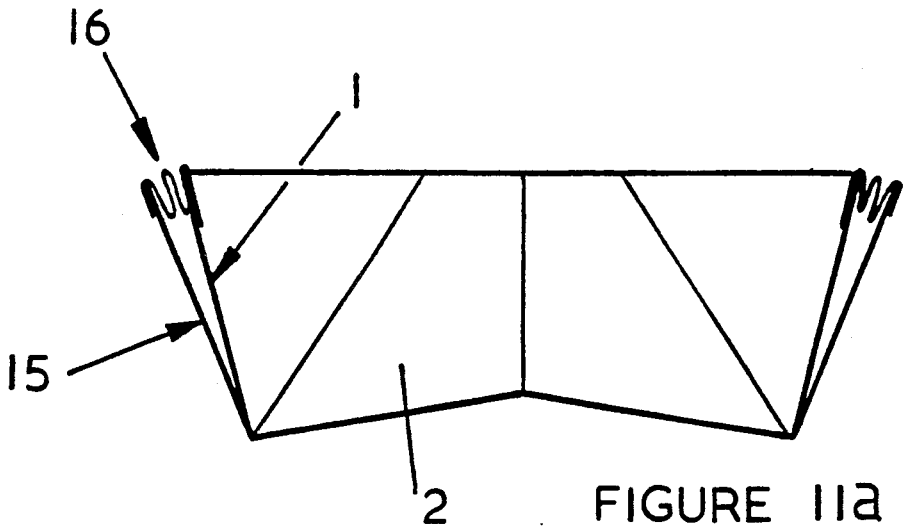
Figure 11B:
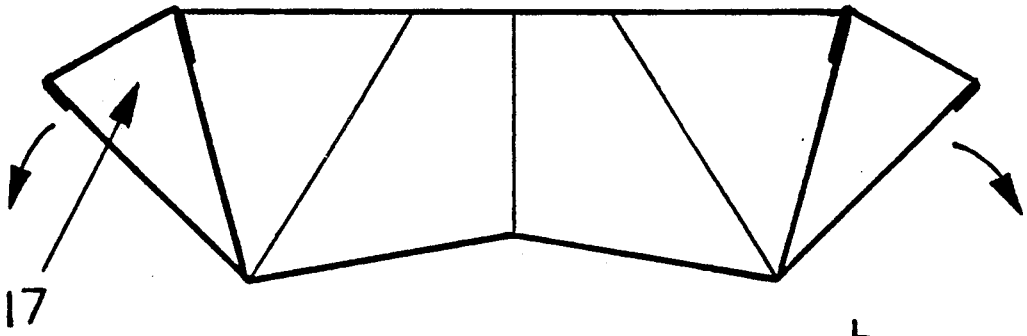
Figure 11C:
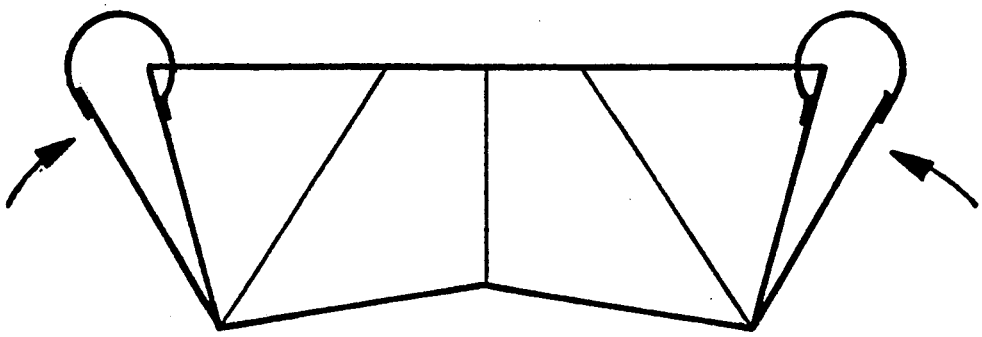
Figure 12A:
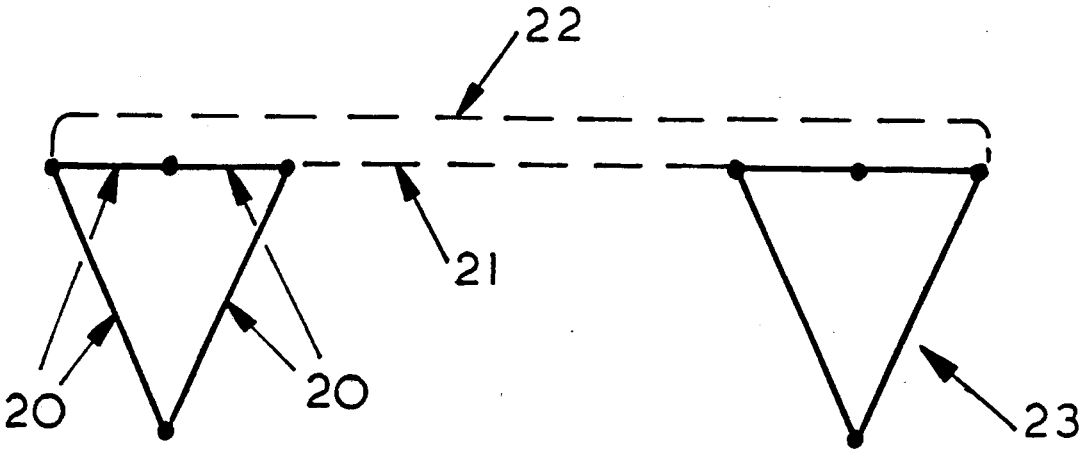
Figure 12B:
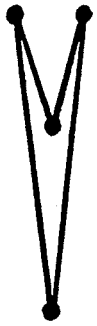
Figure 13:
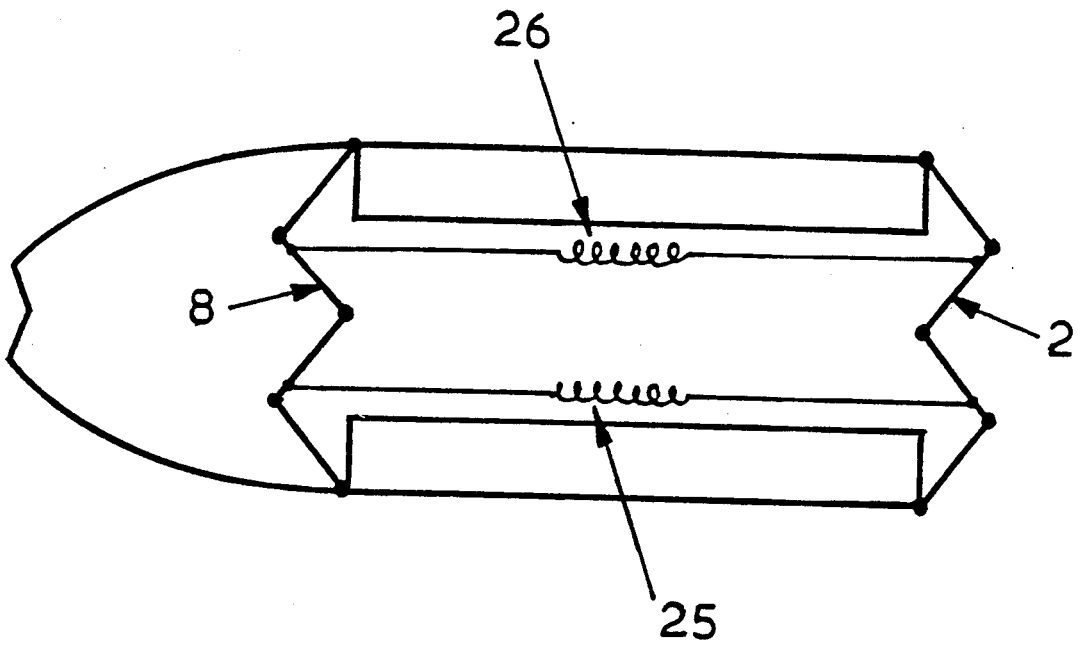

FIGS. 4*a* and 4*b* show alternative embodiments of buoyancy tank seats;

FIGS. 5*a*, 5*b*, 6*a*, 6*b* and 7 show schematic sectional views of alternative embodiments of the invention;

FIG. 8 shows hinge structures;

FIG. 9 shows an alternative tubular construction;

FIG. 10 shows a boat assembly of complementary units;

FIGS. 11*a*, 11*b* and 11*c* show a modification of the invention;

FIGS. 12*a* and 12*b* illustrate schematically a cross-section of an alternative embodiment of the invention; and FIG. 13 illustrates schematically an automatic erecting mechanism for use with this invention.

Figure 1:
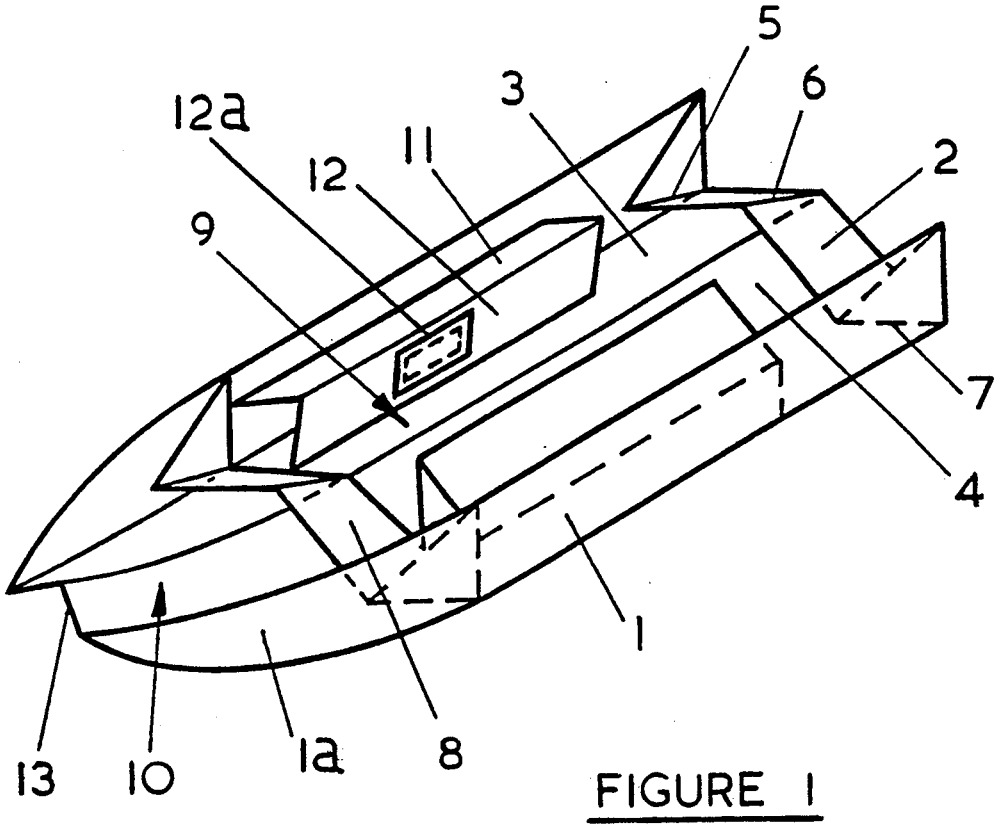
FIG. 1 is a perspective view of an embodiment of the invention in a partially collapsed configuration.

Referring to FIG. 1, a first embodiment of the invention is shown in perspective view from above in a partly collapsed configuration. The vessel comprises a pair of side panels 1 which may be made of wood or plastics material. Each side panel has a flexible bow section 1*a* which enables the panel to lay flat when the boat is completely collapsed and to curve inwardly as the boat is erected. The flexibility may be provided by the inherent property of the material or be enabled by techniques such as selective thinning, segmentation or provision of lines of weakness in the bend axis, for example by scoring across the grain of a wooden board if the grain is longitudinal of the boat length. Laminated structures such as 3-ply (marine ply) wood may be used: to aid flexibility the laminations may be left free in the bow section, and/or the bow section may be formed with the outer ply grain vertical and joined to side panels with the outer ply grain longitudinal.

Figure 2:
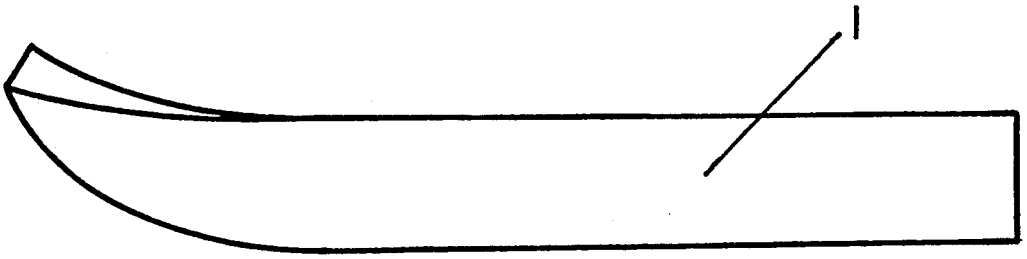
FIG. 2 is a side view of FIG. 1 fully collapsed.

At the stern of the vessel the side boards 1 are interconnected by a stern board or transom 2 which is hingedly connected at its base to respective sections 3 and 4 of the floor of the boat, hingedly connected to the side boards, and also has three hinges 5, 6 and 7 to permit folding as the boat is collapsed. The floor of the boat comprises two sections 3 and 4 which are hinged together at their mutual joint along the longitudinal centre line of the boat and are also hingedly connected to the transom as mentioned above and to the side boards 1. The floor sections are also formed to have flexible bow portions so that as the boat is erected the bow portion of the boat floor curves upwardly. It will be realised from FIG. 2, which shows the boat folded, in side view, that the side boards 1 and floor sections have substantially similar shapes, there being a slight difference at the bow where the floor sections are slightly extended to actually form a blunt nosed bow. If the floor and sides are joined into a pointed bow then the sides and floor sections may for manufacturing convenience have identical shapes.

A front board or bulkhead 8 extends across the boat and separates a crew section 9 from the bow section 10 where the sides and floor commence their curves in the erected position. The bulkhead 8 is formed in a similar manner to the transom 2 and is hinged and connected to the floor sections and sides in a similar manner. Within the crew section 9 a pair of bench seats are provided on respective sides of the boat. The seats each comprise a top panel 11 and a front panel 12, hinged respectively to the side board 1, respective floor section 3 or 4 and to each other. The ends of the seats are enclosed by a flexible material or hinged sections (not shown), and likewise the bow portion of the boat between the bulk head, sides and bow portion 13 of the floor is enclosed by a flexible member. Vents 12*a* to the interior spaces enclosed by the seats and in the bow section are provided.

When the boat is collapsed the side boards 1 and floor sections lie substantially flat with the curved portions flexed to a flat configuration, the hinges between the floor and sides lying in line with the base of the side sections and the hinge between the floor sections lying substantially in line with the tops of the sides. The transom and bulkhead fold towards the bow and along the hinge lines 5, 6 and 7 to follow the folded contour of the sides and base, with hinge 6 folding over the top of the floor hinge and hinges 5 and 7 folding inwardly towards the floor/side hinges. The angle of the hinge lines 6 and 7 depends upon whether the transom is sloping or vertical: for a vertical transom the hinge lines bisect the angle between the connections with the side and floor. The benches also collapse to lie substantially flat. It will be observed that the seats, transom and bulkhead each provide a double thickness of material lying between a respective side and floor section in the folded configuration. Clips or straps may be provided to retain the boat in this folded configuration. In the event of customised storage locations, retention means at the storage location may function to hold the boat closed.

When the clips or other retention means are released the resilience in the curved portions of the side and floor sections is such as to tend to open the boat to the partly open configuration shown in FIG. 1. To complete the opening the floor is pushed further down, the sides out and the transom and bulkhead erected by sternwards movement of the boards. Stays, (not shown) for example on the transom and bulkhead and on the seats, may then be latched in position to retain the boat in the erect position.

Figure 3:
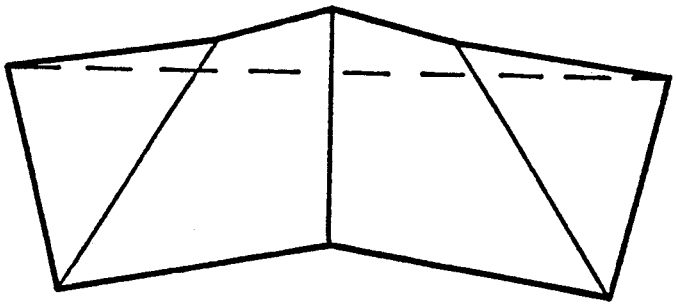
FIG. 3 is a front view of the embodiment of FIG. 1 fully erected.

When erect the base of the boat is not flat athwartships, but is upwardly bowed so that a vertical section athwartships is as shown in FIG. 3 and has a suggestion of a double-hull shape. This provides greater draught and therefore more controllability than a simple flat bottom.

The seats and bow section enclose interior spaces or compartments. When the boat is erected, air is sucked into those compartments through large vents 12*a*. The vents are large so that there is not any substantial resistance to erection of the boat caused by the suction of air into the compartments. Once the boat is erected, with air in the bow and seat compartments, these form natural buoyancy tanks making the boat suitable as a lifeboat. The vents can be sealed by any suitable means, either mechanically or automatically, once the boat is erected. Should any of the compartments become punctured, then because the air is not under pressure there is no tendency for it to escape.

Various modifications to the structure are envisaged, examples of which are now given. The seats may be provided by an alternative framework of struts and flexible panels, as shown in FIG. 4. The tubular framework may be made of aluminium with flexible skins of hypalon material for example. The bench seats and buoyancy compartments also aid rigidity or stiffening of the boat and may be constructed with this in mind, for example additional stays or ties on the diagonal may be provided. Longer side seats/tanks and hence greater stiffness are enabled by outwardly folding transoms and a bowwards folding bulkhead, but this does produce a longer folded configuration.

Figure 5A:
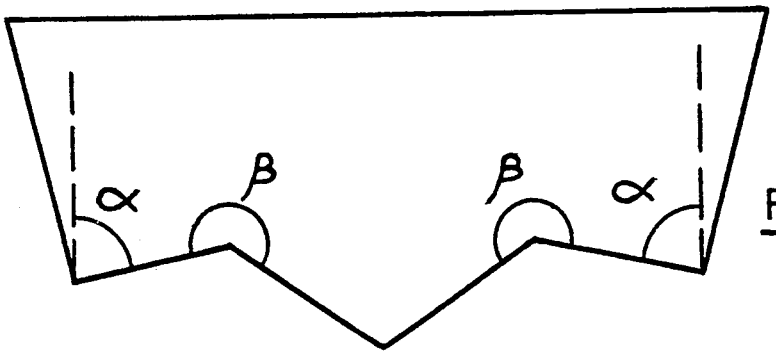
Figure 5B:
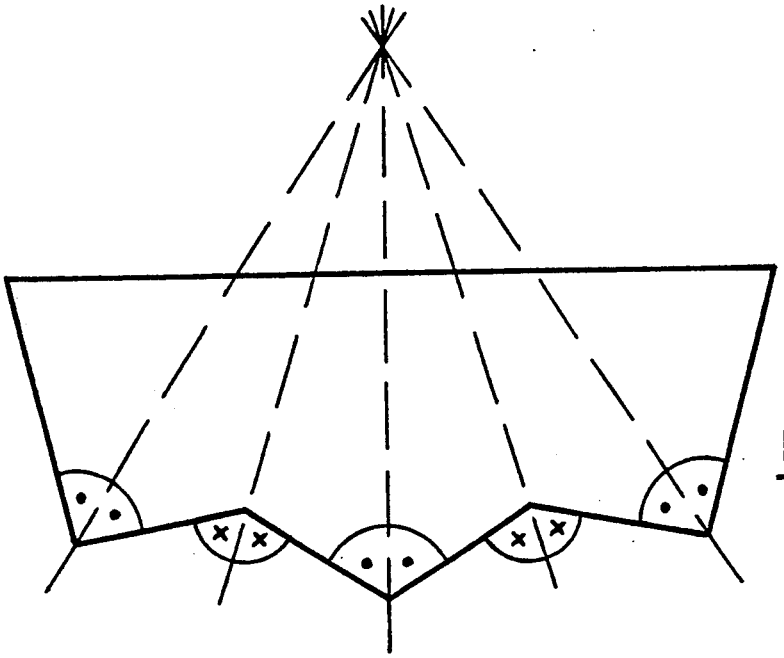
Figure 6A:
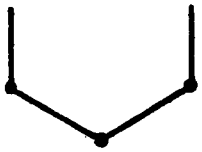
Figure 6B:
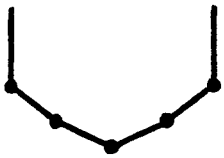

The number of floor sections may be increased to four (or larger, even numbers) with alternative hinged connections being arranged in a zig zag configuration as shown in FIG. 5, for example. The fully open hinge angles may vary between adjacent sections (as shown), but the generally preferred format is for the included angle between vertical and the floor section adjacent the side (angle $\alpha$) to be less than 90°, for the next angle $\beta$ between floor sections to be greater than 180° (and likewise for the next but one angle). Sections between the angles $\beta$ are connected with angles preferably less than 180°. For the panels to fold flat the bisectors of the hinged angles of the panels must converge to a common point as shown in FIG. 5*b*.

A self inflating seat or buoyancy compartment may be incorporated on to the transom, in a similar manner to the seats described, or the transom may fold outwardly rather than inwardly; as mentioned above this provides a more elongate folded structure and enables longer bench seats. Outward transom folding does not so easily lend itself to a buoyancy tank structure on the transom itself, although an outboard buoyancy structure would be possible, however an outwardly folding transom, with inward folding inhibited, is better adapted for receiving an outboard motor and resisting collapse resulting from the thrust of the motor. If folding seats are not provided on the transom and bulkhead, webbing seats or other flexible material attachable to the side panels or seats is preferably provided to provide suitable rowing seat positions. Such webbing seats may also be provided as additional seating.

Alternatively, instantly erected additional buoyancy tanks may be provided as shown in FIGS. 11*a*, 11*b* and 11*c*. In these Figures the additional buoyancy tank is illustrated as being provided on the side 1 but it need not be limited to that location. The buoyancy tank comprises a rigid side 15 hinged to the base of side 1, and a flexible skin 16 shown in a collapsed and folded position in FIG. 11*a*, with the rigid side held against side 1. The flexible skin is attached to the outer edge of the rigid side and near or at the outer edge of side 1. The flexible skin provides a cushioned side which is advantageous for example, for sub-aqua use.

To erect the buoyancy tank, the rigid side is hinged fully away from side 1, pulling the skin 16 taut and thus drawing air in through an inlet valve (not shown) to the compartment 17 enclosed by side 1, the skin, and the rigid side. When the skin is taut the inlet valve is closed either manually or automatically to provide a buoyant air tank. In a further stage shown in 11*c* the rigid side may be compressed a small way towards side 1 in order to inflate the flexible skin and create a flexible "tube" appearance similar to that of the common inflatable boat, the rigid side then being locked in this position to maintain compression of the air tank.

Figure 7:
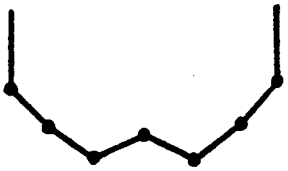
Figure 8A:
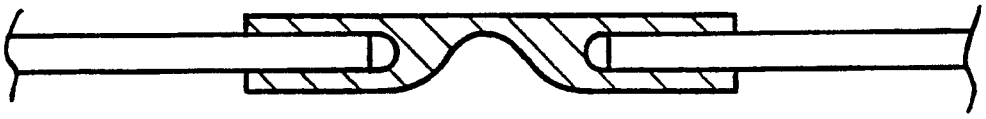
Figure 8B:
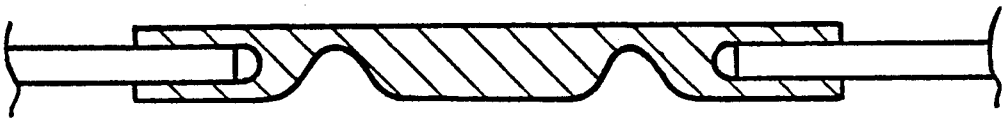
Figure 8C:
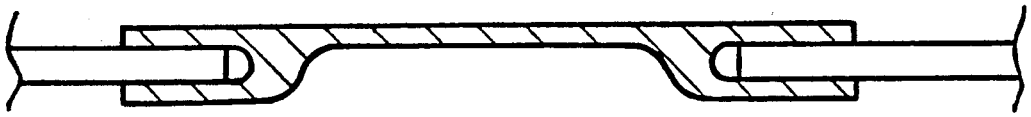
Figure 8D:
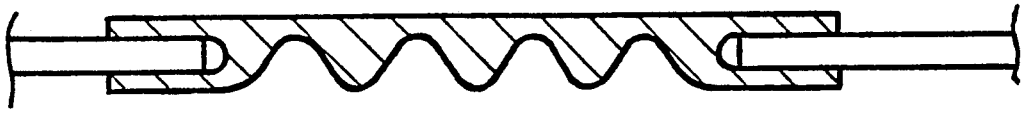
Figure 8E:
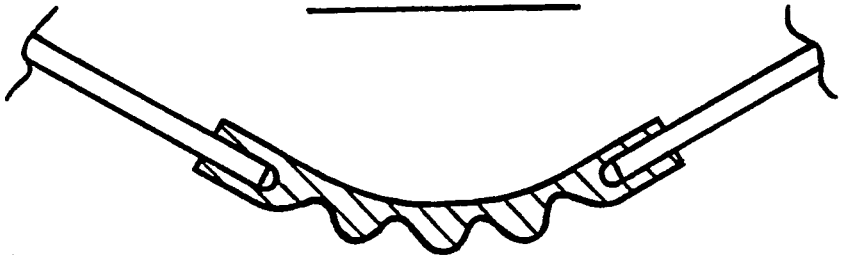

A single hull outline may also be achieved by zig zag folding side and base panels as shown in FIG. 6, but in this configuration the panels are hinged so that when erected the panels all have angles of 180° or less with the interior of the boat having no re-entrant angles. It is possible to combine the type of structure previously described with re-entrant angles on the boat interior and a series of adjacent panels with boat interior angles of 180° or less, as shown in FIG. 7. In general a re-entrant angle is preferred with a wider boat, for reasons of stability.

Any of the embodiments of the folding craft described above may also be provided with a roof structure which may be constructed to be similar to the hull structure, but erected inversely over the hull.

The embodiment illustrated in FIGS. 12*a* and 12*b* is also envisaged, wherein similar hinged panels may be used to provide a self-inflating catamaran. Such a catamaran may consist of panels 20, made of wood or plastics material, which are joined together by hinges to form the base and sides of an inverted isosceles triangle, there being an additional hinge centered at the mid point of the base of the triangle. When this triangle is erected it forms one of the hulls of the catamaran as shown in FIG. 12*a*, this hull being joined by beams 21 and 22 to a second hull 23. The hinges on each hull are positioned such that they may fold flat for storage as shown in FIG. 12*b*. The beams 21 and 22 may be detachable from the two hull portions. Alternatively, the beams may be designed to fold and may thus be used to fold and erect the hulls whilst still attached to them.

Various forms of hinge structures are envisaged. If the boat is made from plastics material the hinges may be integrally formed by flexible longitudinal sections along the hinge lines. This type of hinge may also be formed with a channelled end, for example as shown in FIG. 8, into which panels may be glued. An alternative structure is a metal hinge with a layer of flexible sealing material interposed between the panels and the hinge to provide a waterproof backing for the hinge. In locations where more than one thickness of material, for example the buoyancy tanks or other fillings, is to lie between folded panels, extended or double hinges are preferably provided in order to avoid excessive stress. Buffers may be provided on the surfaces of the panels in the vicinity of the hinge, or on the extended hinges, and with the plastics hinges these may be conveniently formed integrally as ridges. The sides of such ridges should be sloped so that there is no tendency for stones or debris to become trapped: sloped or rounded panel edges that also urge out or prevent entrapment of debris when the hinges are opened may also be provided.

FIG. 9 shows an alternative tubular structure in which the panels are replaced by a framework covered in a skin. The fabric of the skin may be very flexible, e.g. a fabric, or semi rigid. Hypalon is particularly suitable.

A further alternative is for the sections of the boat to be made in units and joined to form the desired configuration as shown in FIG. 10. Additional seating capacity is obtained by adding further crew sections.

The all up weight of a complete boat built from marine 3 ply wood of 5 mm thickness, for an eight foot boat, is of the order of 45 to 50 lbs. Erection of such a craft is possible whether it is in or out of the water.

FIG. 13 illustrates schematically an automatic erecting mechanism for a folding boat according to this invention. The boat is shown in a partially erected position and has an outwardly folding transom 2. Biassing means 25 and 26 are attached between the bulkhead 8 and the transom, which pull the bulkhead and transom into their extended, erect, and rigid positions ready for use of the craft. The biassing means may be provided by springs, fluid struts or elastic cord, for example.

It is an advantage of the present invention that no compressed carbon dioxide gas cyclinders are necessary in the erection of the craft, and that the whole process of erection is readily reversible.

I claim:

1. A collapsible boat comprising:

at least one pair of base segments having longitudinal edges along which they are hingedly interconnected;

a pair of side segments having longitudinal edges, each side segment being hingedly interconnected along one of its longitudinal edges to a respective outer longitudinal edges of the base segments;

the hinged interconnections of the side and base segments being such that the side and base segments hinge open to erect the boat and to collapse the boat alternate hinged interconnections rotate in opposite senses so that the base segments fold inwardly of the side segments, the side and base segments being substantially flat when the boat is collapsed and having flexible portions at one end which, when the boat is erected, form a curved bow; and the side segments are provided, inwardly of the boat, with longitudinally disposed sealable vented compartments which admit and retain air when the boat is erected to constitute buoyancy tanks and seats.

2. The boat defined in claim 1 in which said flexible portions are biased to the curved configuration.

3. The collapsible boat defined in claim 1 in which said flexible portions of the side segments comprise tapered width portions and the sides curve inwardly when the boat is erected.

4. The collapsible boat defined in claim 3 in which said flexible portions of the base segments comprise tapered width portions and when the boat is erected the base segments curve upwardly.

5. The boat defined in claim 1 in which said side and base segments further comprise flexible portions forming a curved stern.

6. The boat defined in claim 5 in which said stern portion comprises a folding transom.

7. The boat defined in claim 6 in which said transom folds outwardly to maximize the length of the buoyancy tanks and seats, which are constructed to act as stiffeners for the boat.

8. The boat defined in claim 1 in which said hinged interconnections all define angles within the erected boat of at most 180°.

9. The boat defined in claim 1 in which at least one hinged interconnection between base segments defines a re-entrant angle within the erect boat.

10. The boat defined in claim 9 in which said re-entrant angle is along the center line of the boat.

11. The boat defined in claim 1 in which said vented compartments comprise bench seats along each side segment with enclosed compartments defined beneath the seats, the seats folding flat against the segments when the boat is collapsed and when the boat is erected the bench seat defining the upper surface of the buoyancy tank.

12. The boat defined in claim 11 in which said seats and enclosed compartment are formed by a hinged tubular framework and a flexible covering.

13. The boat defined in claim 1 wherein biasing means are provided to aid erection of the boat.

14. The boat defined in claim 1 wherein a further segment is hingedly attached at a lower edge externally of the boat and at its upper and side edges is joined by means of a flexible skin to provide an additional buoyancy tank.

15. The boat of claim 1 in which at least some of the segments comprise solid panels.

16. The boat of claim 1 in which at least some of the segments comprise a framework with a flexible covering.

17. In a collapsible boat comprising hinged, interconnecting sections which open and close to erect and collapse the boat, the improvement comprising longitudinally extending seats with enclosed compartments defined beneath the seats, the seats folding flat when the boat is collapsed and the compartments being vented so that when the boat is erected the compartments constitute buoyancy tanks and the seats define the upper surface of the buoyancy tank.

18. The improvement of claim 17 in which the seats and buoyancy tank are further constructed to act as stiffeners for the boat.

19. The improvement of claim 17 in which the boat is further provided with means for biasing to the erect configuration.

20. The improvement of claim 17 in which the vented compartments are sealable after the boat is erected.

21. The improvement of claim 17 in which at least one of the hinged, interconnecting sections of the boat comprises a framework with a flexible covering.

22. The improvement of claim 17 in which at least one of the hinged, interconnecting sections of the boat comprise solid panels.

* * * * *